United States Patent [19]

Hunter

[11] Patent Number: 5,075,588

[45] Date of Patent: Dec. 24, 1991

[54] ARC DISCHARGE LAMP WITH SPRING-MOUNTED ARC TUBE AND SHROUD

[75] Inventor: Scott R. Hunter, Rockport, Mass.

[73] Assignee: GTE Products Corporation, Danvers, Mass.

[21] Appl. No.: 623,140

[22] Filed: Dec. 6, 1990

[51] Int. Cl.[5] ..... H01J 61/34
[52] U.S. Cl. ..... 313/25
[58] Field of Search ..... 313/25

[56] References Cited

U.S. PATENT DOCUMENTS 3,250,934 5/1966 Peterson ..... 313/42 X
4,678,960 7/1987 Reiling ..... 313/25
4,888,517 12/1989 Keeffe et al. ..... 313/25

FOREIGN PATENT DOCUMENTS 467025 6/1937 United Kingdom ..... 313/25
815893 7/1959 United Kingdom ..... 313/25

*Primary Examiner*—Palmer C. DeMeo
*Attorney, Agent, or Firm*—Joseph S. Romanow

[57] ABSTRACT

A metal halide arc discharge lamp includes an arc tube and a light-transmissive shroud mounted within a lamp envelope. The arc tube and the shroud are mechanically supported within the lamp envelope by resilient spring members. Since the support structure for the arc tube and the shroud is mechanically and electrically isolated from the lamp stem, leakage current between the support structure and the electrical inleads is eliminated, thereby reducing sodium loss from the arc tube and extending the operating life of the lamp. The spring-mounted construction enables the lamp to withstand mechanical shock and vibration.

17 Claims, 3 Drawing Sheets

ARC DISCHARGE LAMP WITH SPRING-MOUNTED ARC TUBE AND SHROUD

FIELD OF THE INVENTION

This invention relates to arc discharge lamps and, more particularly, to arc discharge lamps wherein the arc tube and the shroud are mounted within the lamp envelope with springs. The lamp has an extended operating life and the ability to withstand mechanical shock and vibration.

BACKGROUND OF THE INVENTION

High intensity metal halide arc discharge lamps include an arc tube sealed within a light-transmissive lamp envelope. Electrical energy is coupled through a lamp stem to the arc tube. Metal halide arc discharge lamps frequently include a shroud which provides performance and safety improvements. The shroud comprises a cylindrical, light-transmissive member, such as quartz, that is able to withstand the high operating temperatures of the lamp. The arc tube and the shroud are coaxially mounted within the lamp envelope, with the arc tube positioned within the shroud.

A shroud open at one end and having a domed configuration at the other end for use in a low wattage metal halide lamp is disclosed in U.S. Pat. No. 4,499,396 issued Feb. 12, 1985 to Fohl et.al. and U.S. Pat. No. 4,580,989 issued Apr. 8, 1986 to Fohl et.al. The shroud is suggested as being useful in reducing heat loss from the arc tube by convection and thereby raising the temperature of the arc tube and increasing the vapor pressure of the volatile metal halide additives in the arc discharge. Sodium loss is stated to be reduced when the shroud is used in a gas-filled lamp envelope.

Sodium is an important constituent in most high intensity metal halide arc discharge lamps, usually in the form of sodium iodide or sodium bromide. Sodium is used to improve the efficacy and color rendering properties of these lamps. It has long been recognized that arc tubes containing sodium lose sodium during discharge lamp operation. Sodium is lost by the movement, or migration, of sodium ions through the arc tube wall. The iodide originally present in a metal halide lamp as sodium iodide is freed by sodium loss, and the iodide combines with mercury in the arc tube to form mercury iodide. Mercury iodide leads to increased reignition voltages, thereby causing starting and lamp maintenance problems.

In U.S. Pat. No. 4,281,274 issued July 28, 1981 to Bechard et.al., a miniature arc tube containing sodium iodide is located within a gas-filled outer envelope. The arc tube is mounted within a shroud that is open at both ends. The shroud is electrically biased with a DC voltage in order to repel positive sodium ions which have migrated through the wall of the arc tube and to attract electrons produced in the lamp envelope by the photoelectric effect. This technique is not suitable for AC operation of an arc tube, since the positive bias is provided on the shroud only during one-half of the AC voltage cycle.

A prior attempt to reduce sodium loss from AC metal halide lamps was the use of a so-called "frameless construction" described in U.S. Pat. No. 3,424,935 issued Jan. 28, 1969 to Gungle et.al. In the frameless construction, there are no frame members close to the arc tube. The electrical connection to the upper electrode is a fine tungsten wire spaced as far away from the arc tube as possible. Although this configuration reduces sodium loss, sodium loss is still evident near the end of the life of such lamps.

Another technique for reducing sodium loss is disclosed in U.S. Pat. Nos. 4,620,125 issued Oct. 28, 1986 to Keeffe et.al. and U.S. Pat. No. 4,625,141 issued Nov. 25, 1986 to Keeffe et.al. A low wattage metal halide discharge lamp includes an evacuated envelope containing a heat reducing member and an arc tube within the heat reducing member. The heat reducing member and the arc tube have a metal band and an outer strap adjacent to one another and adjacent to one electrode. The metal band, outer strap and electrode are all electrically connected to an electrical lead of one polarity, whereby sodium loss from the arc tube is reduced.

Other techniques for reducing sodium loss from arc discharge lamps are disclosed by Keeffe et.al. in *Journal of Illumination Engineering Society*, Summer 1988, pages 39–43; U.S. Pat. No. 4,963,790 issued Oct. 16, 1990 to White et.al.; Japanese Patent No. 60-40138 published July 30, 1976 and U.S. Pat. No. 4,843,266 issued June 27, 1989 to Santo et.al.

In the aforementioned U.S. Pat. Nos. 4,499,396 and 4,580,989, two techniques are disclosed for mounting the shroud in the lamp. In a first technique, the shroud is held in place by two shroud straps which are welded to a supporting frame. Straps positioned around each end of the arc tube are also welded to the frame and thereby support the arc tube. In a second technique, slots are cut in the shroud, and the shroud is held in place by the straps which support the arc tube. Although these lamps perform generally satisfactorily, the shroud straps permit excessive axial movement of the shroud during shipping and handling, and the slotted shroud tends to crack during manufacturing and operation.

These issues are addressed in pending application Serial No. 07/539,752 filed June 18, 1990. The disclosed mounting arrangement includes a frame comprising one or two support rods, and upper and lower clips for retaining the shroud and the lamp capsule. The clips, which are welded to the support rods, prevent both axial and lateral movement of the shroud. The frame is attached to the base end of the lamp envelope by a strap which encircles the lamp stem.

Although the lamps disclosed in application Serial No. 07/539,752 are mechanically strong and relatively simple to construct and are able to survive shipping and handling without significant breakage, these lamps have been found to have a shorter operating life than is known to be achievable. The shorter operating life is due primarily to an excessive rate of voltage rise and changes in the color temperature of the lamp during operation, which are indicative of sodium loss. One technique that has been used to increase the life of these lamps is to place a strip of insulating material under the strap which secures the frame to the lamp stem. The purpose of the insulating strip is to reduce leakage currents between the frame and the inleads to the arc tube. Although the insulating strip has been found to increase the life of the lamp, this modification is expensive to implement, increases the number of rejected lamps during the manufacturing process and does not increase the operating life to the extent desired.

Resilient bumpers, or bulb spacers, are used to stabilize an arc tube structure within a lamp envelope in the aforementioned U.S. Pat. No. 3,424,935. A spring extending between the dome end of a lamp envelope and the dome of a shroud is disclosed in the aforementioned U.S. Pat. No. 4,499,396. However, in all prior art known to applicant, the arc tube is generally rigidly mounted within the lamp envelope, and springs or other resilient members are used to supplement the rigid support and to stabilize the arc tube in a desired position.

It is a general object of the present invention to provide improved arc discharge lamps.

It is another object of the present invention to provide arc discharge lamps wherein voltage rise and changes in color temperature during the operating life of the lamp are limited.

It is a further object of the present invention to provide arc discharge lamps wherein sodium migration from the arc tube is suppressed.

It is yet another object of the present invention to provide arc discharge lamps which are capable of withstanding mechanical shock and vibration.

It is still another object of the present invention to provide arc discharge lamps which have long operating lives.

It is a further object of the present invention to provide arc discharge lamps which are simple in construction and low in cost.

SUMMARY OF THE INVENTION

According to the present invention, these and other objects and advantages are achieved in an electric lamp comprising a sealed lamp envelope including a lamp stem, a lamp subassembly located within the lamp envelope, means for coupling electrical energy through the lamp stem to the lamp subassembly, and plural resilient members coupled between the lamp subassembly and the lamp envelope for resilient mounting of the lamp subassembly. The plural resilient members provide mechanical support for the lamp subassembly in the lamp envelope. The lamp subassembly includes a lamp capsule for generating light upon application of electrical energy, a generally cylindrical, light-transmissive shroud disposed around the lamp capsule, and first and second retainers attached to opposite ends of the lamp capsule and retaining the shroud between them.

The resilient members preferably comprise springs coupled between each of the retainers and the lamp envelope. The springs limit axial and radial movement of the lamp subassembly relative to a central axis of the lamp envelope. Preferably, the springs include angled springs coupled between the retainers and the lamp envelope. Each angled spring is oriented at an acute angle relative to the axis of the lamp envelope so as to limit both axial and radial movement of the lamp subassembly relative to the lamp envelope. The acute angle is preferably in a range of about 20°–70°. Electrical inleads extending through the lamp stem and connected to the lamp capsule each include a resilient portion which permits movement of the lamp subassembly relative to the lamp envelope.

In a preferred embodiment, the lamp further includes a first ring clip attached to the first retainer and a second ring clip attached to the second retainer. The springs extend between each of the ring clips and the lamp envelope. Preferably, the first and second ring clips each include an annular portion having axial tabs for retaining the shroud. The springs that are coupled between the ring clips and the lamp envelope are oriented at an acute angle relative to the axis of the lamp so as to limit both axial and radial movement of the lamp subassembly. In a preferred embodiment, each ring clip and the associated springs are integrally formed.

BRIEF DESCRIPTION OF THE DRAWINGS

For a better understanding of the present invention, together with other and further objects, advantages and capabilities thereof, reference is made to the accompanying drawings which are incorporated herein by reference and in which.

DESCRIPTION OF THE PRIOR ART

Figure 1:
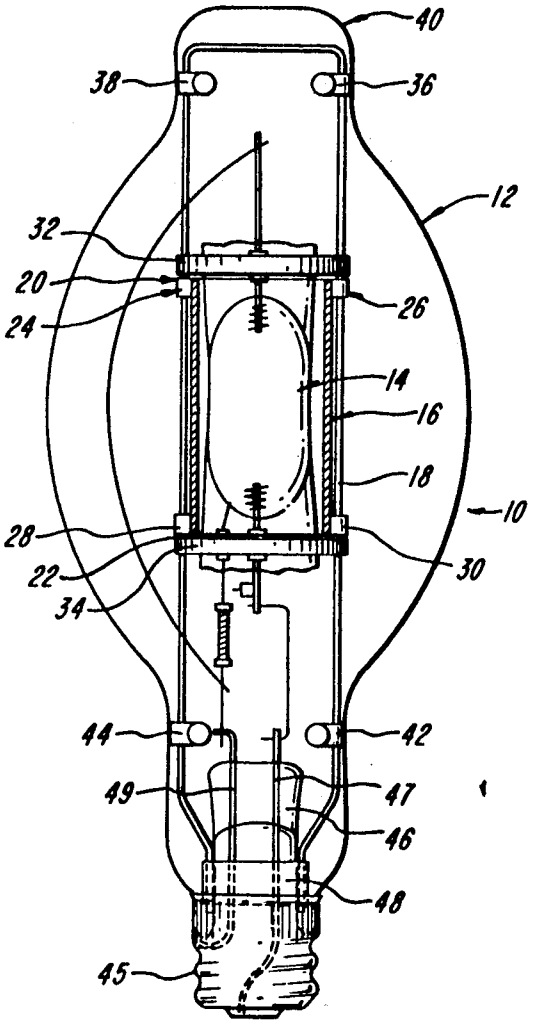
FIG. 1 is a cross-sectional view of an arc discharge lamp in accordance with the prior art.

A metal halide arc discharge lamp 10 in accordance with the prior art is shown in FIG. 1. The lamp 10 includes a lamp envelope 12 and an arc tube 14 mounted within the lamp envelope. The arc tube 14 is positioned within a cylindrical, light-transmissive shroud 16. The shroud 16 and the arc tube 14 are supported within the lamp envelope 12 by a frame 18. The shroud 16 is held in place such that it cannot move axially or radially by annular ring clips 20 and 22 located at opposite ends of shroud 16. The ring clips 20 and 22 are welded to the frame 18 by means of tabs 24 and 26 on clip 20 and tabs 28 and 30 on clip 22. The arc tube 14 is secured to frame 18 by straps 32 and 34 attached to opposite ends of the arc tube 14.

The frame 18 is secured within the lamp envelope 12 by stainless steel bulb spacers 36 and 38 at the dome end 40 of the lamp envelope 12 and by bulb spacers 42 and 44 at the base end of the lamp envelope. The bulb spacers limit radial movement of the frame 18 within the lamp envelope 12. In addition, the frame is secured to the lamp stem 46 by a stem strap 48 which surrounds the lamp stem 46 and is welded to frame 18. The strap 48 rigidly mounts the frame 18 to the lamp envelope 12 and prevents axial movement of the frame 18 in either direction. Electrical energy is coupled from a lamp base 45 through electrical inleads 47 and 49 to the arc tube 14. A strip of mica is sometimes positioned between strap 48 and lamp stem 46 in order to increase the electrical impedance between inleads 47 and 49 and frame 18.

As indicated previously, arc discharge lamps of the type shown in FIG. 1 have exhibited increases in operating voltage and color temperature, which are indicative of sodium loss from the arc tube. It is believed that the sodium loss is due to the comparatively low impedance between the electrical inleads 47 and 49 at the lamp stem 46 and the strap 48 at lamp operating temperatures. The charge built up on the shroud 16 and frame 18 due to the loss of photoelectrons and/or the gain in sodium ions is constantly neutralized by leakage currents through the lamp stem 46 between the, strap 48 and inleads 47 and 49. As indicated above, a mica strip has been used under the strap 48 for reducing leakage currents. However, the mica strip is relatively expensive to implement and does not increase the lamp life to the extent desired.

The impedance between the strap 48 and inleads 47 and 49 has been measured both with and without a mica strip under strap 48. In addition, the impedance was measured with a nitrogen-filled lamp envelope 12 and with an evacuated lamp envelope. The impedance was highest when a mica strip was used in an evacuated lamp envelope. The presence of nitrogen or other gas in the lamp envelope promotes convective heat losses from the arc tube and raises the temperature of the lamp envelope and lamp stem of a lamp that is operated in the base-up configuration. The impedance of the glass used in the outer envelope is highly dependent on temperature and has a reduced impedance at higher temperatures. Thus, the impedance between strap 48 and inleads 47, 49 is reduced, and sodium loss is increased, when the operating temperature of the lamp stem is increased.

DETAILED DESCRIPTION OF THE INVENTION

Figure 2:
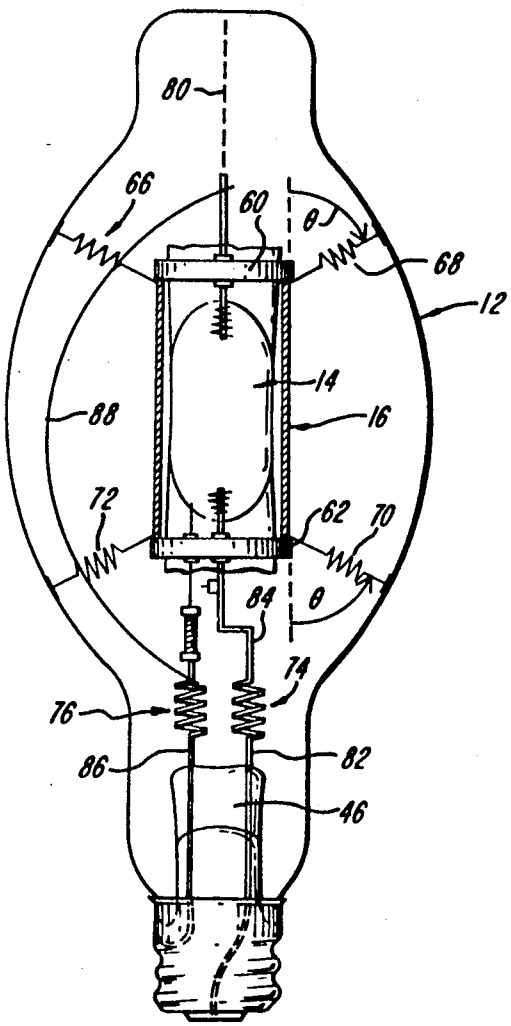
FIG. 2 is a schematic representation of an arc discharge lamp in accordance with the invention.

An arc discharge lamp in accordance with the present invention is shown schematically in FIG. 2. Corresponding elements in FIGS. 1 and 2 have the same reference numerals. The lamp of FIG. 2 does not include a frame. The arc tube 14 comprises a conventional metal halide arc tube having electrodes at opposite ends and a starting electrode. The arc tube encloses a fill material including mercury and one or more metal halides. Sodium is typically present in the form of sodium iodide or sodium bromide. The shroud 16 is cylindrical and is fabricated of a light-transmissive, heat resistant material such as quartz. A strap 60 is attached to one end of arc tube 14, and a strap 62 is attached to the other end of arc tube 14. The straps 60 and 62 are attached to press seal regions of the arc tube 14 and include extensions which retain the shroud 16 in a fixed position relative to arc tube 14.

The arc tube 14 and the shroud 16 are mechanically decoupled from the lamp stem 46 and are secured within the lamp envelope 12 by springs 66, 68, 70, 72, 74 and 76. A subassembly, including arc tube 14, shroud 16 and straps 60 and 62, is supported entirely by the springs within the lamp envelope. Springs 66 and 68 are connected between strap 60 and lamp envelope 12. Springs 70 and 72 are connected between strap 62 and lamp envelope 12. Each of the springs 66, 68, 70 and 72 is mounted at an angle r with respect to a central axis 80 of the lamp. By mounting the springs 66, 68, 70 and 72 at an angle r, axial and radial support is provided for arc tube 14 and shroud 16. Springs 66 and 68 limit axial movement of the arc tube 14 and shroud 16 toward the dome end of lamp envelope 12. Springs 70 and 72 limit axial movement of arc tube 14 and shroud 16 toward the base end of the lamp envelope 12. For most effective support, springs 66, 68, 70 and 72 should be approximately perpendicular to the inside surface of lamp envelope 12 at the respective points of contact. The preferred angle r is approximately 45° such that the axial and radial forces exerted by springs 66, 68, 70 and 72 are approximately equal. However, values of the angle r between 20° and 70° provide adequate support for arc tube 14 and shroud 16. A conductive spring 74 is connected between high voltage inlead 82 and the base end electrode lead 84. A conductive spring 76 is connected between the ground inlead 86 and connection wire 88. Springs 74 and 76 permit displacement of arc tube 14 relative to lamp envelope 12 and provide some support for the arc tube 14 in the axial direction.

Preferably, the springs 66, 68, 70 and 72 shown in FIG. are strips of spring stainless steel with indented dimples at the ends for contact with the glass of lamp envelope 12. It is important to avoid sharp projections in contact with the lamp envelope 12, which can be a source of cracking of the lamp envelope glass. Any material which is capable of withstanding the operating temperatures of the lamp and is resilient and deformable without permanently retaining the deformed shape, is suitable for the springs.

Figure 4:
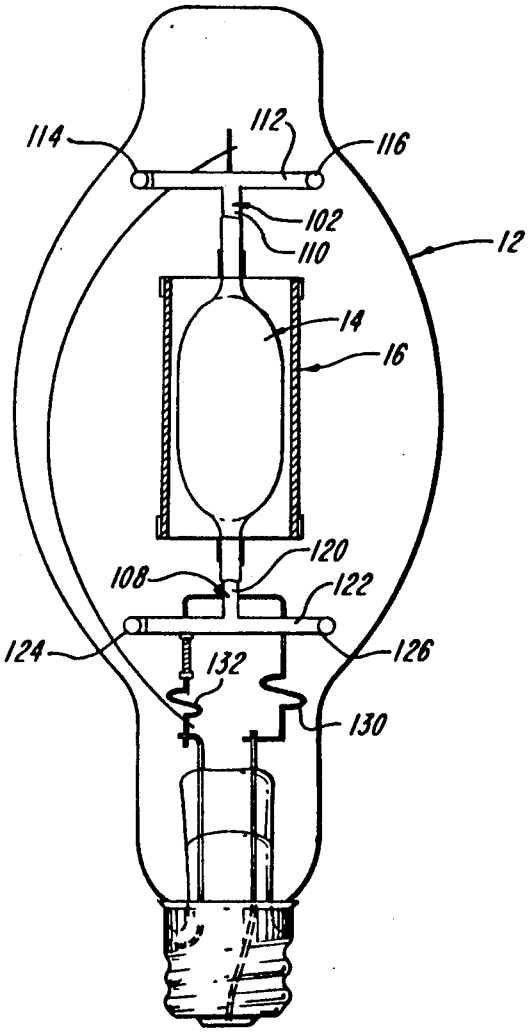
FIG. 4 is a cross-sectional view of the arc discharge lamp of FIG. 3 taken along the line 4—4 of FIG. 3.
Figure 3:
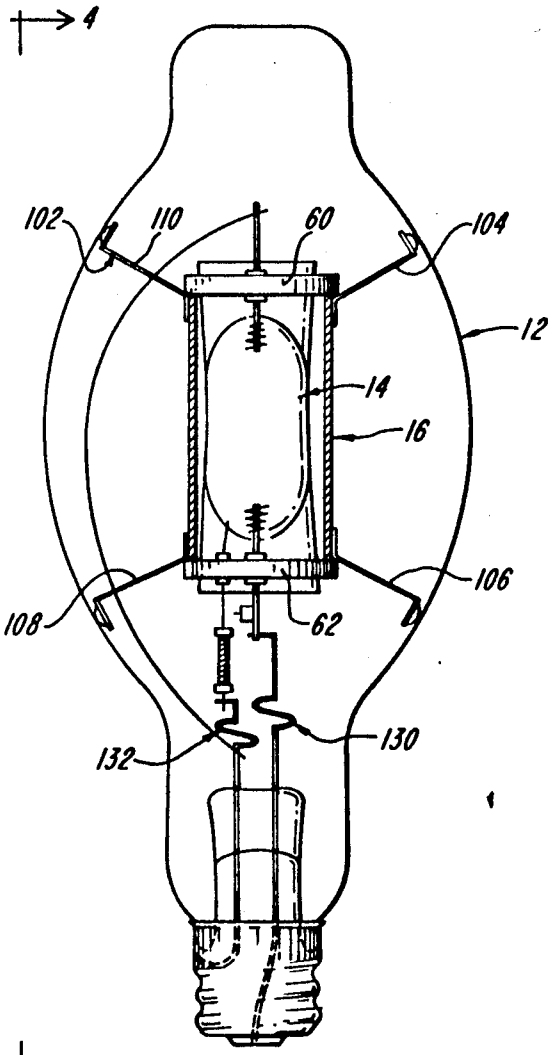
FIG. 3 is a cross-sectional view of an arc discharge lamp in accordance with a first embodiment of the invention.

A practical embodiment of the invention is shown in FIGS. 3 and 4. Corresponding elements in FIGS. 2, 3 and 4 have the same reference numerals. Springs 102 and 104 are coupled between strap 60 and lamp envelope 12. Springs 106 and 108 are coupled between strap 62 and lamp envelope 12. The springs 102, 104, 106 and 108 are fabricated as strips of spring stainless steel. As best shown in FIG. 4, spring 102 includes an angled portion 110 and a cross member 112 perpendicular to angled portion 110. The ends of cross member 112 have dimples 114 and 116 for contact with the inside surface of lamp envelope 12. Similarly, spring 108 includes an angled portion 120, cross member 122 and dimples 124 and 126. The springs 104 and 106 are constructed in the same manner as springs 102 and 108. The cross members 112 and 122 provide additional radial support for the arc tube 14 and shroud 16 within the lamp envelope 12. Springs 130 and 132 are connected in series with the electrical inleads to arc tube 14. The springs 130 and 132 are fabricated of stiff wire capable of carrying the operating current for arc tube 14.

Figure 6:
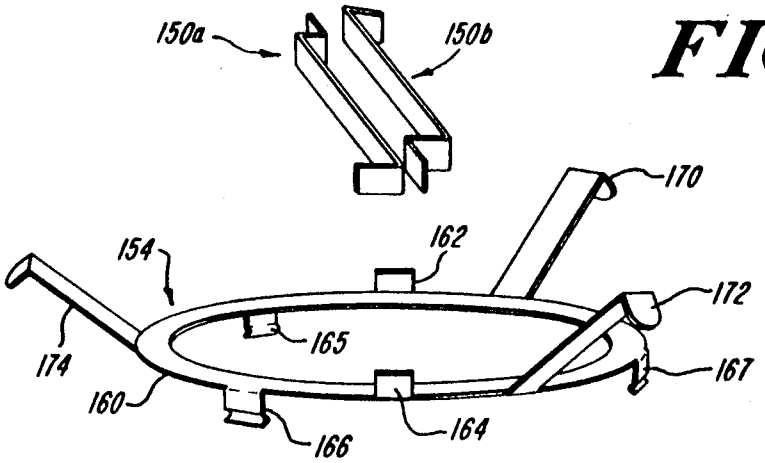
FIG. 6 is a perspective view of the ring clip used in the lamp of FIG. 5.
Figure 7:
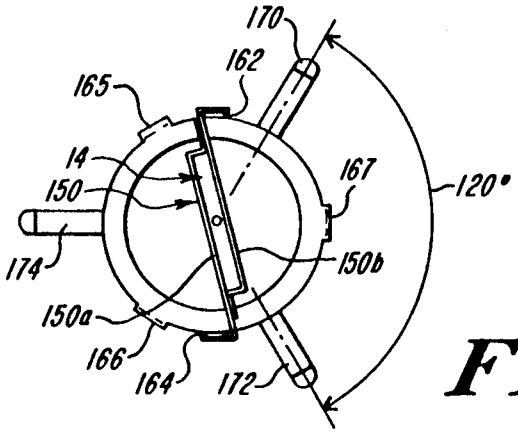
FIG. 7 is a top view of the arc tube subassembly in the lamp of FIG. 5.
Figure 5:
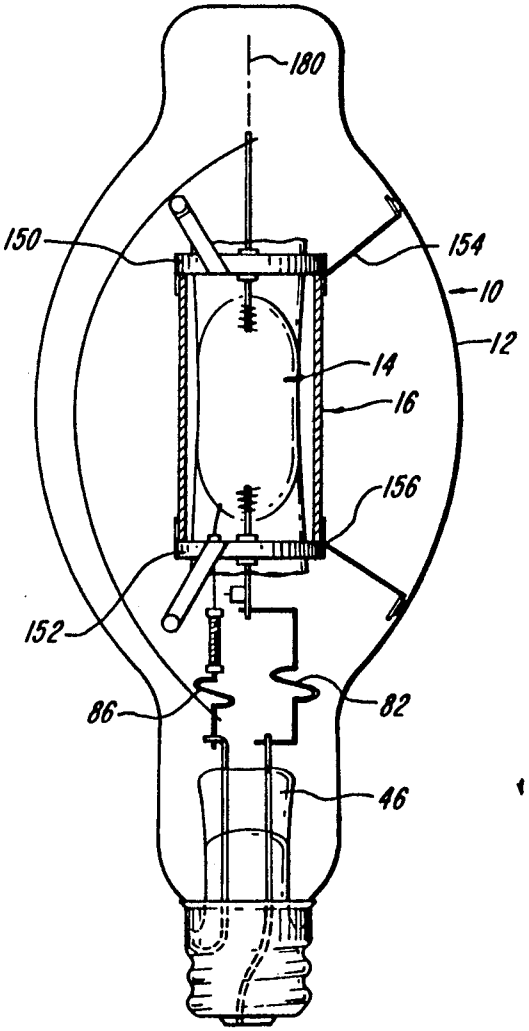
FIG. 5 is a cross-sectional view of an arc discharge lamp in accordance with a second embodiment of the invention.

A second embodiment of the invention is shown in FIGS. 5–7 Corresponding elements in FIGS. 2 and 5–7 have the same reference numerals. A strap 150 is attached to the press seal region at one end of arc tube 14, and a strap 152 is attached to the press seal region at the other end of arc tube 14. The strap 150 is connected to a ring clip 154, and the strap 152 is connected to a ring clip 156. As best seen in FIG. 7, the strap 150 includes metal strips **150*a* and 150*b*, the ends of which are welded together so that the press seal region of arc tube 14 is secured between strips 150*a* and 150*b***.

The ring clip 154 includes an annular ring portion 160 of approximately the same diameter as shroud 16. The strap 150 is welded to tabs 162 and 164 which extend upwardly from annular ring 160. The annular ring 160 also includes downwardly extending tabs 165, 166 and 167 which fit snugly over the outside of shroud 16 and retain shroud 16 in a fixed position relative to arc tube 14. The ring clip 154 further includes spring portions 170, 172 and 174 extending outwardly from annular ring 160. The spring portions 170, 172 and 174 are preferably equally spaced around the periphery of annular ring 160 and extend at acute angles relative to the plane of annular ring 160. The spring portions 170, 172 and 174 couple the ring clip 154 to the lamp envelope 12 for resilient mounting of the arc tube 14 and shroud 16. Each of the spring portions 170, 172 and 174 includes a dimpled end for contact with the inside surface of lamp envelope 12. The angle between the direction of spring portions 170, 172 and 174 and a central axis 180 of the lamp is preferably in the range of about 20° to 70°. Most preferably the angle is about 45° so that equal radial and axial forces are exerted on the arc tube 14 and the shroud 16. The strap 152 and the ring clip 156 at the other end of arc tube 14 have the same construction as strap 150 and ring clip 154 shown in FIGS. 6 and 7.

The ring clips 154 and 156 can be stamped and fabricated from a single sheet of flexible but stiff stainless steel or similar material. The construction shown in FIGS. 5–7 involves a relatively small number of structural elements in the manufacture of the lamp, thereby reducing the number of fabrication and welding operations.

The embodiments shown in FIGS. 3–7 and described hereinabove are characterized by having a subassembly including arc tube 14 and shroud 16, which is mechanically supported by a plurality of resilient spring members. The springs securely mount to the subassembly within the lamp envelope 12 but permit a small amount of relative movement between the subassembly and the lamp envelope in the event of mechanical shock or vibration. Since the mounting structure for the arc tube and the shroud is mechanically and electrically isolated from the lamp stem, leakage currents to the electrical inleads are eliminated. As a result, sodium loss from the arc tube is suppressed, and the operating life of the lamp is extended.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An electric lamp comprising:

a sealed lamp envelope including a lamp stem having two electrical lead-in wires passing through said tern;

a lamp subassembly located within said lamp envelope, said lamp subassembly including a lamp capsule for generating light upon application of electrical energy, a generally cylindrical, light-transmissive shroud disposed around said lamp capsule, and first and second retainers attached to opposite ends of said lamp capsule and retaining said shroud between them;

means for coupling electrical energy through said lamp stem to said lamp capsule; and plural springs coupled between said lamp subassembly and said lamp envelope for resilient mounting of said lamp subassembly, said plural springs providing mechanical support for said lamp subassembly in said lamp envelope, said lamp subassembly being mechanically and electrically isolated from said lamp stem, said electrical isolation being sufficient to substantially eliminate leakage currents passing through said lamp stem to said electrical lead-in wires.

2. An electrical lamp as defined in claim 1 wherein said plural springs include springs coupled between each of said first and second retainers and said lamp envelope.

3. An electrical lamp as defined in claim 1 wherein said lamp envelope has a central axis and wherein said plural springs limit axial and radial movement of said lamp subassembly relative to said lamp envelope.

4. An electrical lamp as defined in claim 3 wherein said plural springs include one or more angled springs coupled between each of said first and second retainers and said lamp envelope and oriented at an acute angle relative to said axis so as to limit both axial and radial movement of said lamp subassembly relative to said lamp envelope.

5. An electrical lamp as defined in claim 4 wherein said acute angle is in a range of about 20° to 70°.

6. An electrical lamp as defined in claim 1 wherein said means for coupling electrical energy includes electrical inleads extending through said lamp stem and connected to said lamp capsule, each of said inleads including a resilient portion permitting movement of said lamp subassembly relative to said lamp envelope

7. An electrical lamp as defined in claim 2 wherein said springs coupled between said first and second retainers and said lamp envelope each comprise a strip of spring material having one or more dimples for contact with said lamp envelope.

8. An electrical lamp as defined in claim 3 further including a first ring clip attached to said first retainer and a second ring clip attached to said second retainer, said plural springs extending between said first and second ring clips and said lamp envelope

9. An electrical lamp as defined in claim 8 wherein said first and second ring clips each include an annular portion having axial tabs for retaining said shroud

10. An electrical lamp as defined in claim 8 wherein the springs coupled between said first and second ring clips and said lamp envelope are oriented at an acute angle relative to said axis so as to limit both axial and radial movement of said lamp subassembly relative to said lamp envelope.

11. An arc discharge lamp comprising:

a sealed lamp envelope including a lamp stem;

a subassembly located within said lamp envelope, said subassembly including a metal halide arc tube for generating light upon application of electrical energy, a generally cylindrical light-transmissive shroud disposed around said arc tube, and first and second straps attached to opposite ends of said arc tube and retaining said shroud between them;

electrical inleads for coupling electrical energy through said lamp stem to said arc tube; and resilient members coupled between said straps and said lamp envelope for resilient mounting of said subassembly, said resilient members limiting axial and radial movement of said subassembly relative to said lamp envelope.

12. An arc discharge lamp as defined in claim 11 wherein said resilient members include angled springs coupled between said straps and said lamp envelope, each angled spring being oriented at an acute angle relative to a central axis of said lamp envelope so as to limit both axial and radial movement of said subassembly relative to said lamp envelope.

13. An arc discharge lamp as defined in claim 12 wherein said acute angle is in the range of about 20° to 70°.

14. An arc discharge lamp as defined in claim 12 wherein said acute angle is about 45°.

15. An arc discharge lamp as defined in claim 11 further including a first ring clip attached to said first strap and a second ring clip attached to said second strap, said resilient members extending between said first and second ring clips and said lamp envelope.

16. An arc discharge lamp as defined in claim 15 wherein said first and second ring clips each include an annular portion having tabs for retaining said shroud.

17. An arc discharge lamp as defined in claim 16 wherein the resilient members coupled between said first and second ring clips and said lamp envelope are oriented at an acute angle relative to a central axis of said lamp envelope so as to limit both axial and radial movement of said subassembly relative to said lamp envelope.

* * * * *